US007845744B2

(12) United States Patent
Chen et al.

(10) Patent No.: US 7,845,744 B2
(45) Date of Patent: Dec. 7, 2010

(54) SLIDE MEMBER AND SLIDE ASSEMBLY HAVING THE SLIDE MEMBER

(75) Inventors: Ken-Ching Chen, Kaohsiung Hsien (TW); Hsiu-Chiang Liang, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 613 days.

(21) Appl. No.: 11/889,527

(22) Filed: Aug. 14, 2007

(65) Prior Publication Data

US 2008/0284299 A1 Nov. 20, 2008

(30) Foreign Application Priority Data

May 15, 2007 (TW) ..... 96117315 A

(51) Int. Cl.
*A47B 88/00* (2006.01)

(52) U.S. Cl. ..... 312/334.6; 312/333

(58) Field of Classification Search ..... 312/334.6, 312/334.44, 334.45, 334.46, 333; 384/20
See application file for complete search history.

(56) References Cited

U.S. PATENT DOCUMENTS

| | | | | |
|---|---|---|---|---|
| 4,752,143 | A * | 6/1988 | Lautenschlager, Jr. | 384/19 |
| 5,364,179 | A * | 11/1994 | Brustle et al. | 312/333 |
| 5,769,518 | A * | 6/1998 | Grabher | 312/334.6 |
| 6,682,160 | B2 | 1/2004 | Kung | |
| 6,736,471 | B2 * | 5/2004 | Lin | 312/333 |
| 6,846,053 | B2 * | 1/2005 | Salice | 312/334.14 |
| 6,854,817 | B1 | 2/2005 | Simon | |
| 6,945,620 | B2 | 9/2005 | Lam et al. | |
| 7,240,979 | B2 * | 7/2007 | Chiu | 312/334.9 |
| 2004/0000851 | A1 * | 1/2004 | Lam Harn et al. | 312/334.7 |
| 2004/0227438 | A1 * | 11/2004 | Tseng et al. | 312/333 |
| 2004/0227444 | A1 * | 11/2004 | Booker et al. | 312/334.45 |
| 2005/0225219 | A1 * | 10/2005 | Chen et al. | 312/334.5 |
| 2005/0231083 | A1 | 10/2005 | Garcie | |
| 2006/0097609 | A1 | 5/2006 | Milligan | |
| 2006/0186772 | A1 * | 8/2006 | Lam et al. | 312/333 |
| 2007/0046158 | A1 * | 3/2007 | Hoffman | 312/333 |
| 2007/0132346 | A1 * | 6/2007 | Huang | 312/333 |
| 2007/0188060 | A1 * | 8/2007 | Nussbaumer et al. | 312/333 |

FOREIGN PATENT DOCUMENTS

| | | |
|---|---|---|
| TW | 588611 | 5/2004 |
| TW | 200628097 | 8/2006 |

* cited by examiner

*Primary Examiner*—Darnell M Jayne
*Assistant Examiner*—Andres Gallego
(74) *Attorney, Agent, or Firm*—Rosenberg, Klein & Lee

(57) ABSTRACT

A slide member and a slide assembly having the slide member are provided, in particular to a reinforcing structure of the slide member and the slide assembly. The slide member further comprises an automatic retractable device therein and may be in conjunction with a single-section or two-section slide to from a slide assembly in a stronger structure and a steady sliding operation.

6 Claims, 11 Drawing Sheets

SLIDE MEMBER AND SLIDE ASSEMBLY HAVING THE SLIDE MEMBER

BACKGROUND OF THE INVENTION

1. Field of the Invention

The present invention relates to a slide member and a slide assembly having the slide member, in particular, to a slide member adapted for an undermount drawer slide and having an automatic retractable device, the slide member may be in conjunction with a single-section or two-section slide to form a slide assembly in a stronger structure and a steady sliding operation.

2. Description of the Prior Art

There are numerous drawer slides of the prior art for undermount drawers on the market, such as Taiwanese Patent Publication No. 588,611 (U.S. Pat. No. 6,682,160 B) ·Taiwanese Patent Publication No. 200,628,097 (U.S. Provisional No. 60/625,555) ·U.S. Pat. Nos. 6,854,817 B1 ·6,945,620 B2 ·2005/0231083 A1 and 2006/0097609 A1. All of such designs have the same shortcomings, such as the structure is too weak, and the accessories of the slide assembly are exposed outwardly, thus the parts are easy to break and downgrade the quality.

The present invention provides a slide member and a slide assembly to solve the shortcomings of weak structure and exposure of parts.

SUMMARY OF THE INVENTION

According to a first aspect of the present invention, there is provided a slide member comprising:

a side wall, said side wall extending vertically;

a bottom wall, said bottom wall extending horizontally to connect with said side wall; and a track in a reverse U shape, one side wall of said track extending vertically to connect with said bottom wall.

According to a second aspect of the present invention, there is provided a slide assembly comprising:

a slide member comprising a side wall, a bottom wall and a track, said side wall extending vertically, said bottom wall extending horizontally to connect with said side wall, said track in a reverse U shape having one side wall extending vertically to connect with said bottom wall, a first stopper being provided on the top of one end of said track, a pair of first suspension rollers being provided on two side walls of said track; and a first rail in a reverse U shape, said first rail having a pair of bending sections extending from two side walls thereof, said first rail fitting onto said track of said slide member with said bending sections engaging with said first suspension rollers, a first bearing carrier being provided between said first rail and said track.

Preferably, said first stopper comprises a first supporting roller with a portion exposing outward from the top of said first stopper.

Preferably, said first bearing carrier comprises a first base in a reverse U shape and first rollers are provided on the top and two sides of said first base.

Preferably, a retracting base is provided under said track of said slide member, said retracting base comprising a vertical engaging section and a horizontal bottom board, said engaging section having a tenon and a through hole, said bottom board having a trough, a pulling part being inserted through said trough, a first linking part being provided on one of said side walls of said first rail, an axle being inserted through said track to secure said first suspension rollers, a locking hole being disposed on one of said side walls of said track, said engaging section of said retracting base being inserted into said track, said tenon engaging with said locking hole and said axle being inserted through said through hole of said engaging section.

Preferably, an elastic element is provided between said engaging section of said retracting base and said track, said elastic element having two ends connected to said engaging section and said pulling part, respectively, and said first linking part of said first rail being linked with said pulling part.

Preferably, a buffering member is provided between said track and said engaging section of said retracting base, said buffering member comprising a fixed end and a buffer rod, said fixed end engaging with said engaging section, said buffer rod facing said pulling part extending automatically.

Preferably, said pulling part comprises a block and a hook, said block being connected with said elastic member, said hook being pivotally connected to said block and inserted through said trough, said hook engaging with said first linking part of said first rail.

Preferably, a second rail in a reverse U shape is provided on said first rail, said second rail having a pair of bending sections extending from two side walls thereof, a second stopper being provided on the top of one end of said first rail, a pair of second suspension rollers being provided on said two side walls of said first rail, said bending sections of said second rail engaging with said second suspension rollers, a second bearing carrier being provided between said first rail and said second rail.

Preferably, said second rail comprises a second linking part on one of said side walls of said second rail.

Preferably, said second stopper comprises a second supporting roller with a portion exposing outwardly from the top of said second stopper.

Preferably, said second bearing carrier comprises a second base in a reverse U shape, second rollers being provided on the top and two sides of said second base.

Compared to the prior art, the present invention has the following advantages:

a. having a stronger structure and steady movement.

b. providing a reverse U-shaped space to store and protect an automatic retractable device and a buffer device.

DETAILED DESCRIPTION OF THE PREFERRED EMBODIMENTS

Figure 1:
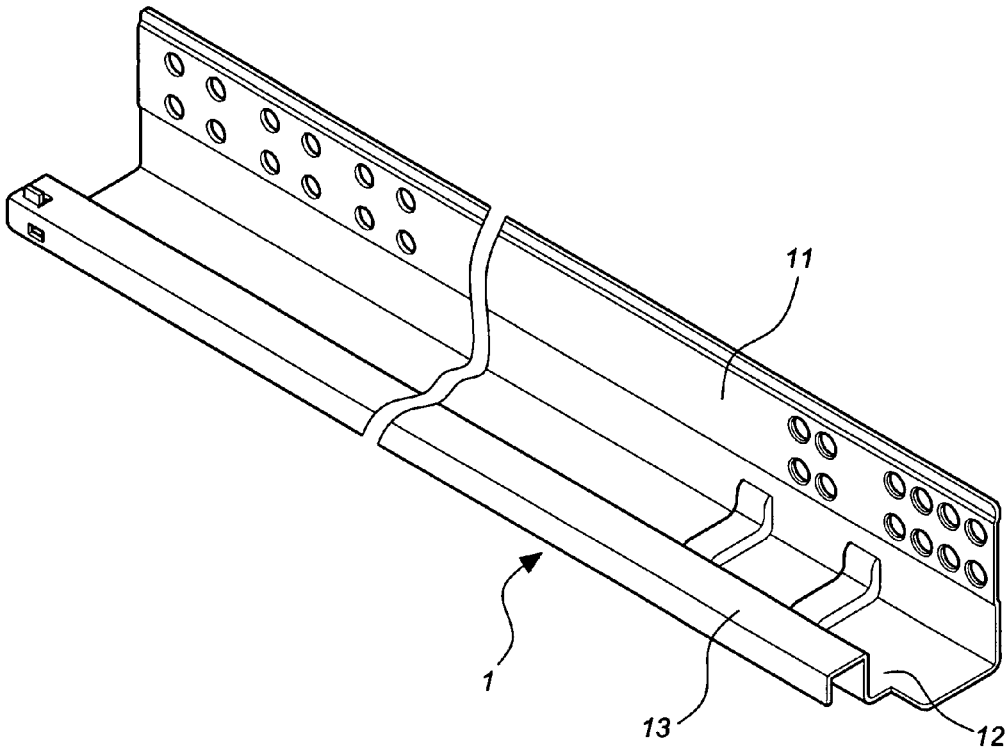
FIG. 1 is a perspective view of a slide member of the present invention.

As shown in FIG. 1, a slide member 1 of a preferred embodiment of the present invention comprises a side wall 11, a bottom wall 12 and a track 13. The side wall 11 extends vertically. The bottom wall 12 extends horizontally to connect with the side wall 11. The track 13 is in a reverse U shape. One side wall of the track 13 extends vertically to connect with the bottom wall 12.

Figure 2:
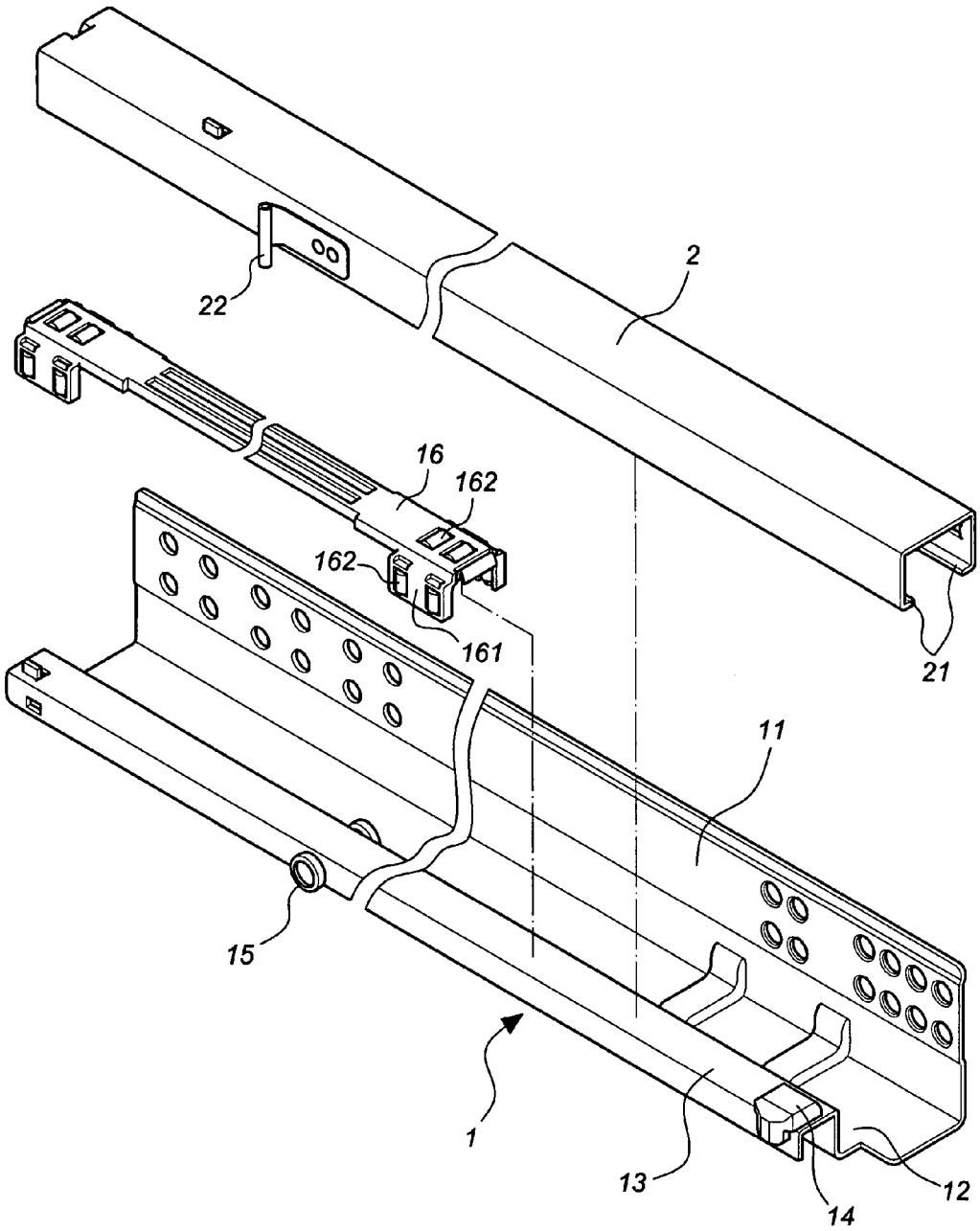
FIG. 2 is an exploded view of the slide member in conjunction with a first rail of a first embodiment of the present invention.
Figure 3:
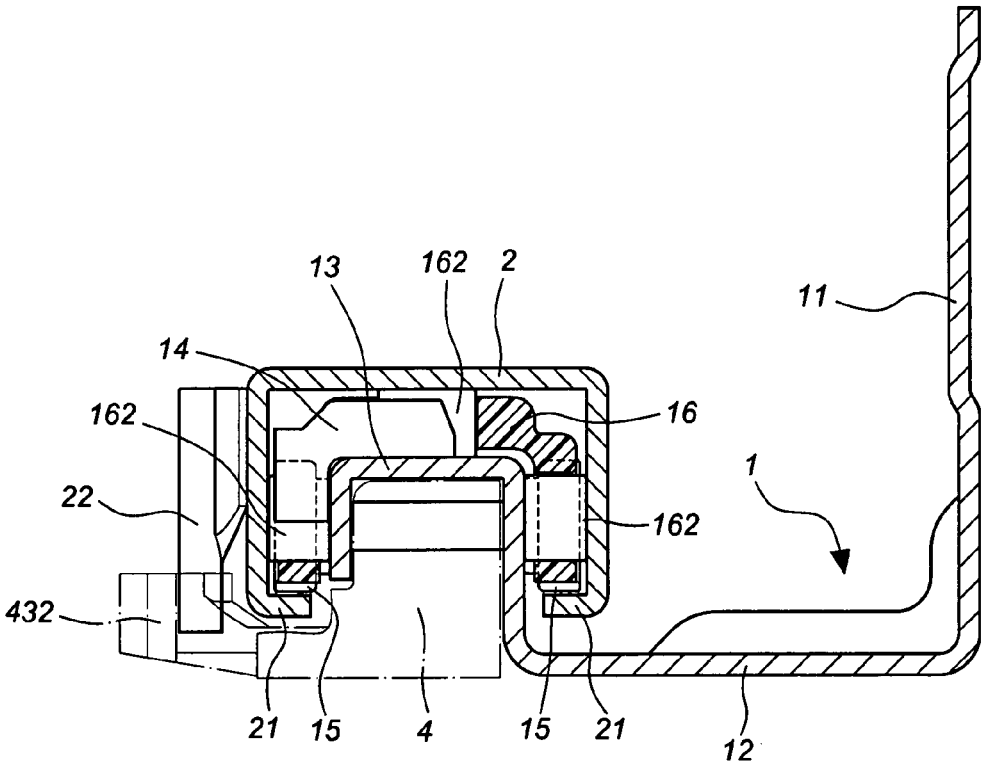
FIG. 3 is a cross-sectional view of the slide member and the first rail of the first embodiment of the present invention.
Figure 4:
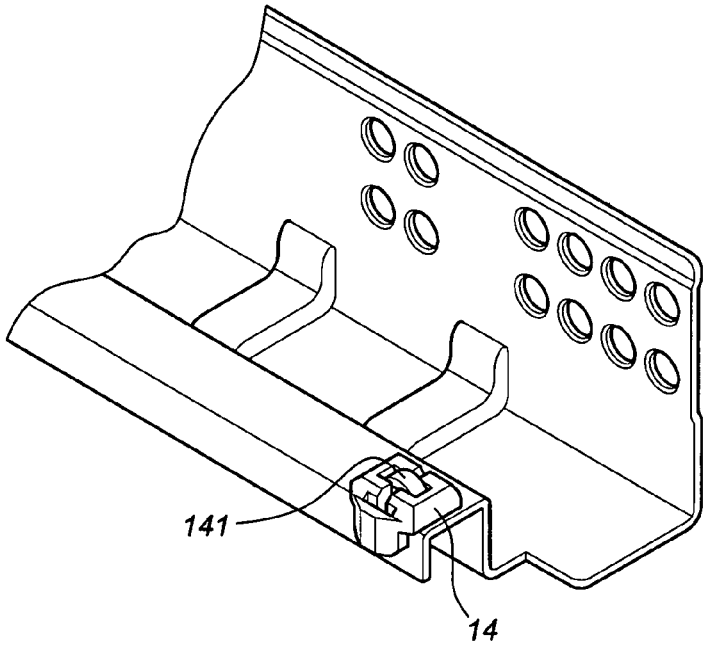
FIG. 4 is a perspective view of a first stopper and a first supporting roller of the first embodiment of the present invention.

As shown in FIGS. 2 and 3, the slide member 1 is in conjunction with another one-section slide to form a slide assembly. The track 13 of the slide member 1 is provided with a first stopper 14 on one end of the track 13 and a pair of first suspension rollers 15 on two side walls of the track 13. A first rail 2 fits onto the track 13 of the slide member 1. The first rail 2 is in a reverse U shape. The first rail 2 has a pair of bending sections 21 extending from two side walls thereof. The bending sections 21 engage with the first suspension rollers 15. One end of the first rail 2 is provided with a first linking part 22. A first bearing carrier 16 is provided between the first rail 2 and the track 13. The first bearing carrier 16 comprises a first base 161 in a reverse U shape. First rollers 162 are provided on the top and two sides of the first base 161. The first bearing carrier 16 will be stopped by the first stopper 14. As shown in FIG. 4, the first stopper 14 may be provided with a first supporting roller 141 with a portion exposed outwardly from the top of the first stopper 14.

Figure 5:
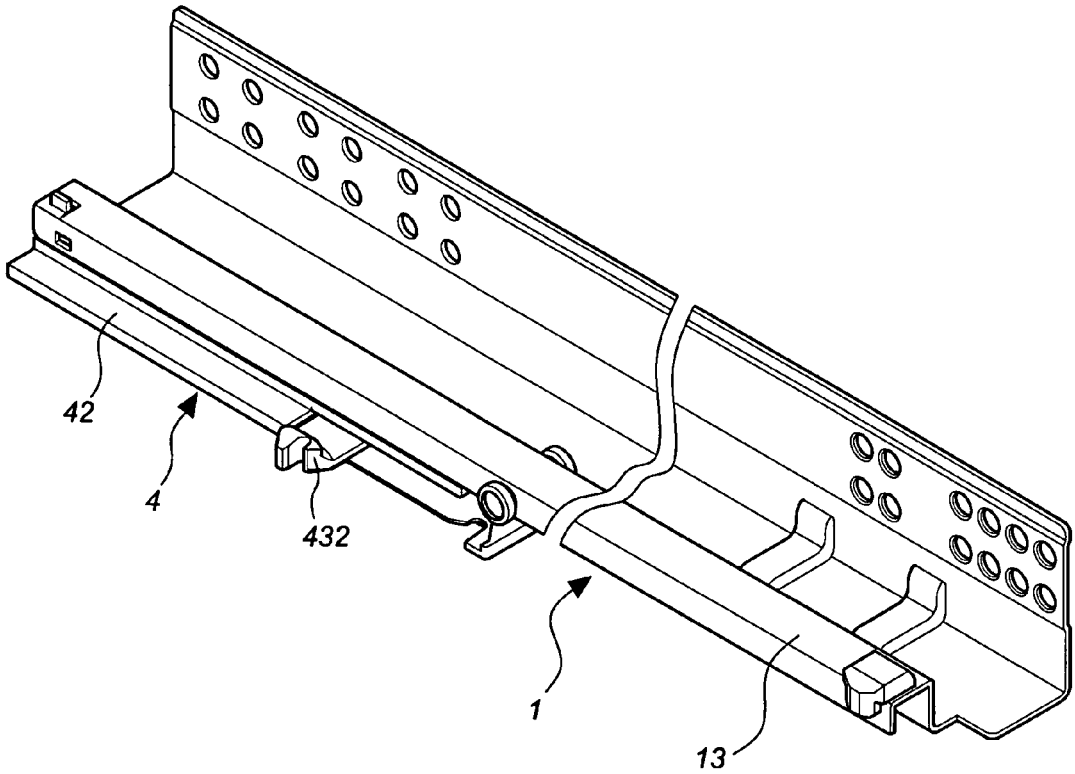
FIG. 5 is a perspective view of the slide member and an automatic retractable device of the first embodiment of the present invention.
Figure 6:
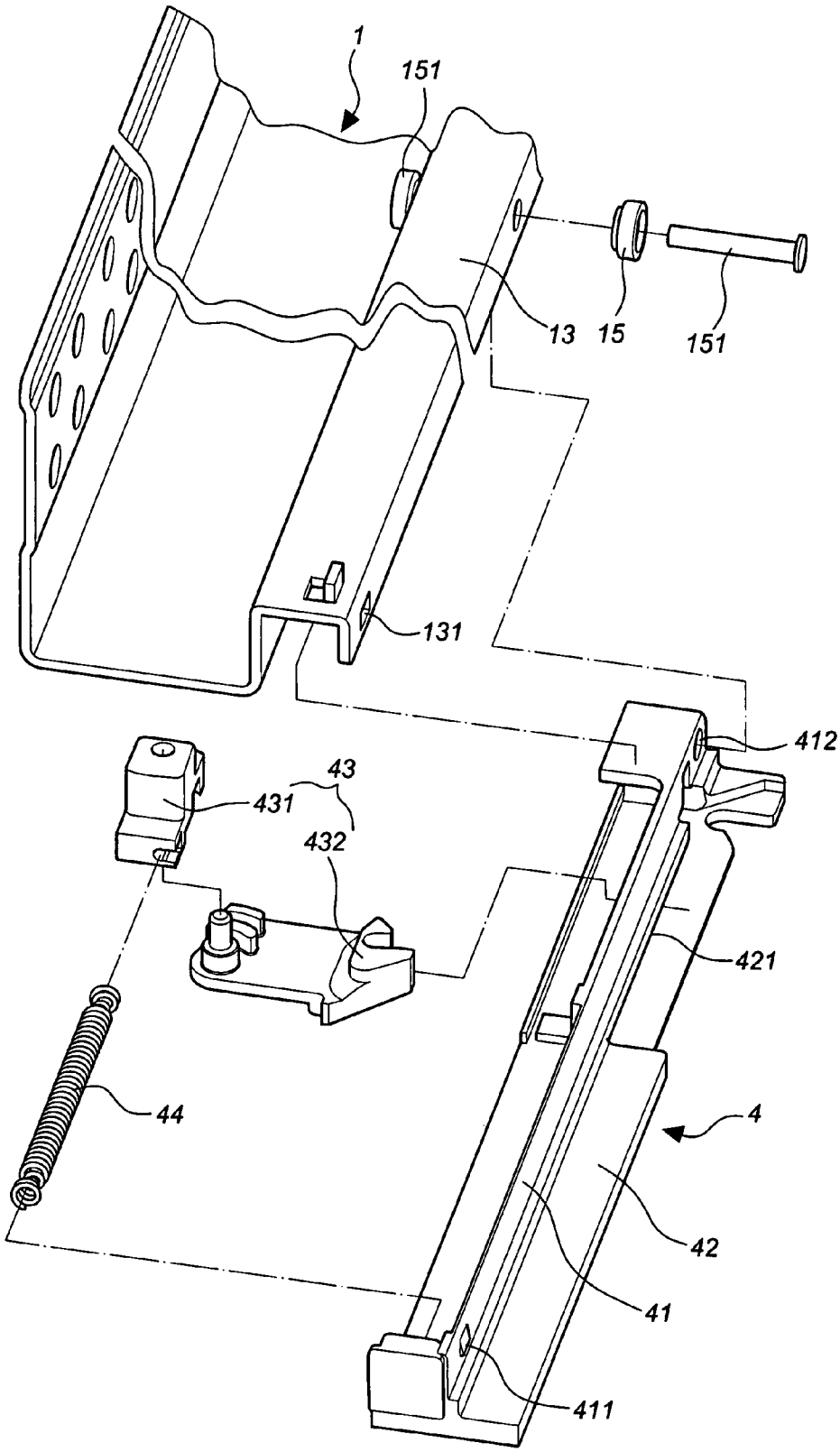
FIG. 6 is an exploded view of the slide member and the automatic retractable device of the first embodiment of the present invention.

The slide assembly further comprises an automatic retractable device. As shown in FIGS. 5 and 6, a retracting base 4 is provided under the track 13 of the slide 1. The retracting base 4 comprises a vertical engaging section 41 and a horizontal bottom board 42. The engaging section 41 has a tenon 411 and a through hole 412. The engaging section 41 of the retracting base 4 is inserted and secured to the track 13. The track 13 has a locking hole 131 on one side wall thereof. An axle 15 is inserted through the track 13 to secure the first suspension rollers 15. The tenon 41 of the engaging section 41 engages with the locking hole 131, and the axle 151 is inserted through the through hole 412 of the engaging section 4 to secure the retracting base 4. The bottom board 42 of the retracting base 4 further comprises a trough 421. A pulling part 43 is inserted through the trough 421. The pulling part 43 comprises a block 431 and a hook 432. The hook 432 is pivotally connected to the block 431, and can be swung slightly. As shown in FIG. 3, the first linking part 22 of the first rail 2 engages with the hook 432 of the retracting base 4. An elastic element 44 is provided on the engaging section 41 of the retracting base 4. The elastic element 44 has two ends connected to the end of the engaging section 41 and the block 431 of the polling part 43, respectively.

Figure 7:
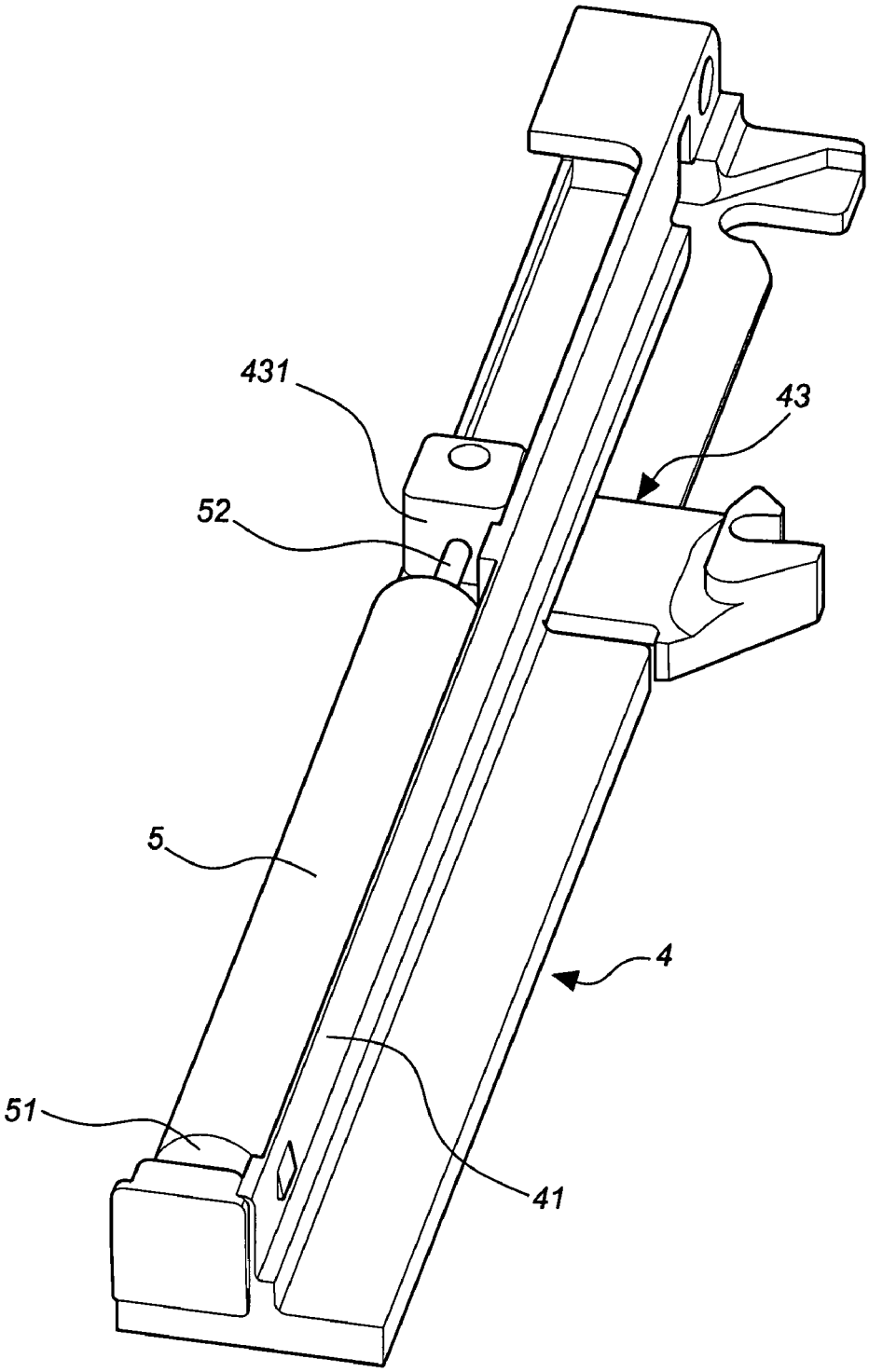
FIG. 7 is a perspective view of the automatic retractable device and a buffering member of the first embodiment of the present invention.

The above-mentioned slide assembly having an automatic retractable device further comprises a buffer device. A buffering member 5 is provided between the track 13 and the engaging section 41 of the retracting device 4, as shown in FIG. 7. The buffering member 5 has a fixed end 51 and a buffer rod 52. The fixed end 51 engages with the end of the engaging section 41, and the buffer rod 52 facing the block 431 of the pulling part 43 is designed to extend automatically.

Figure 8:
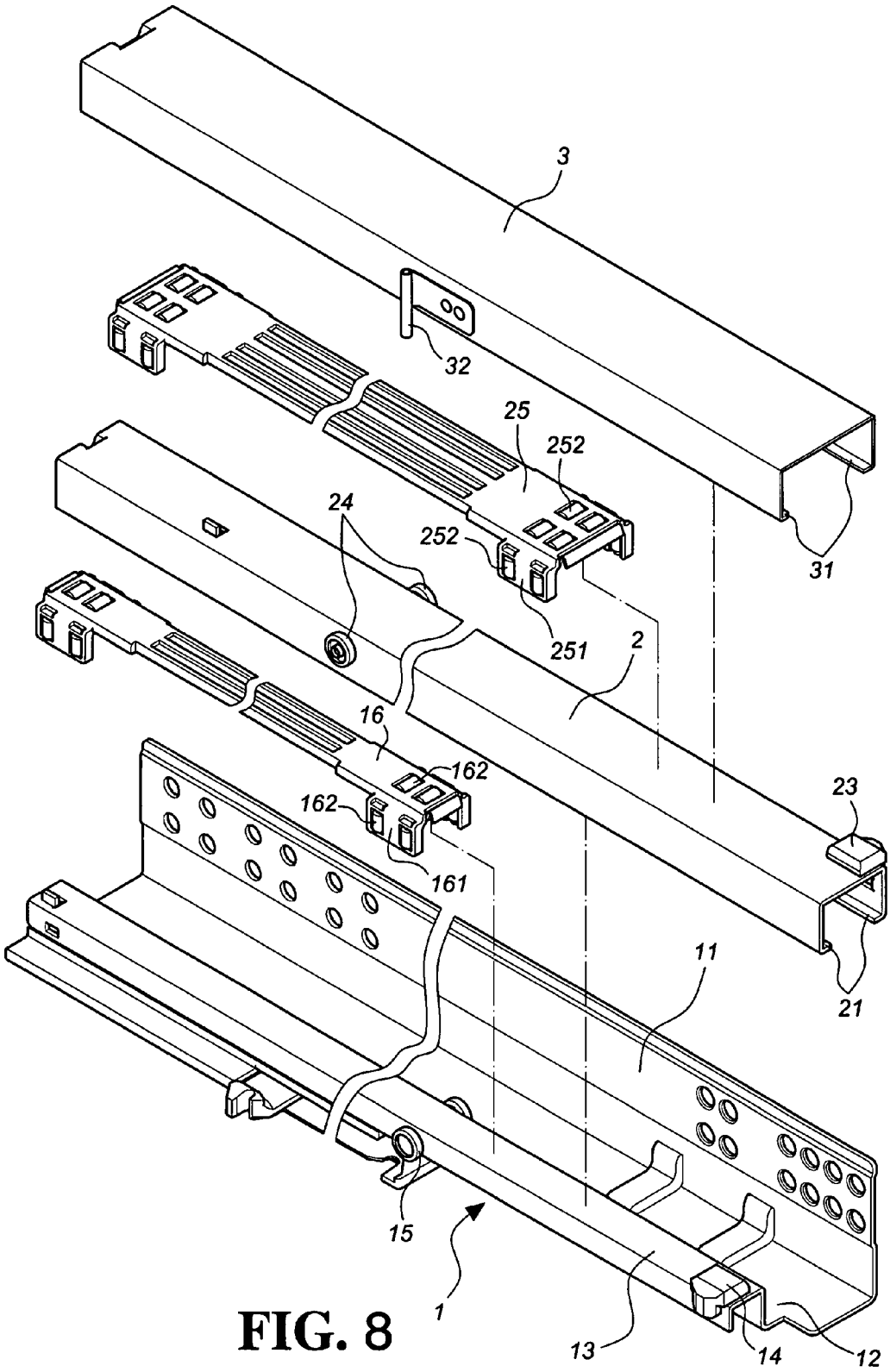
FIG. 8 is an exploded view of a second embodiment of the present invention.
Figure 9:
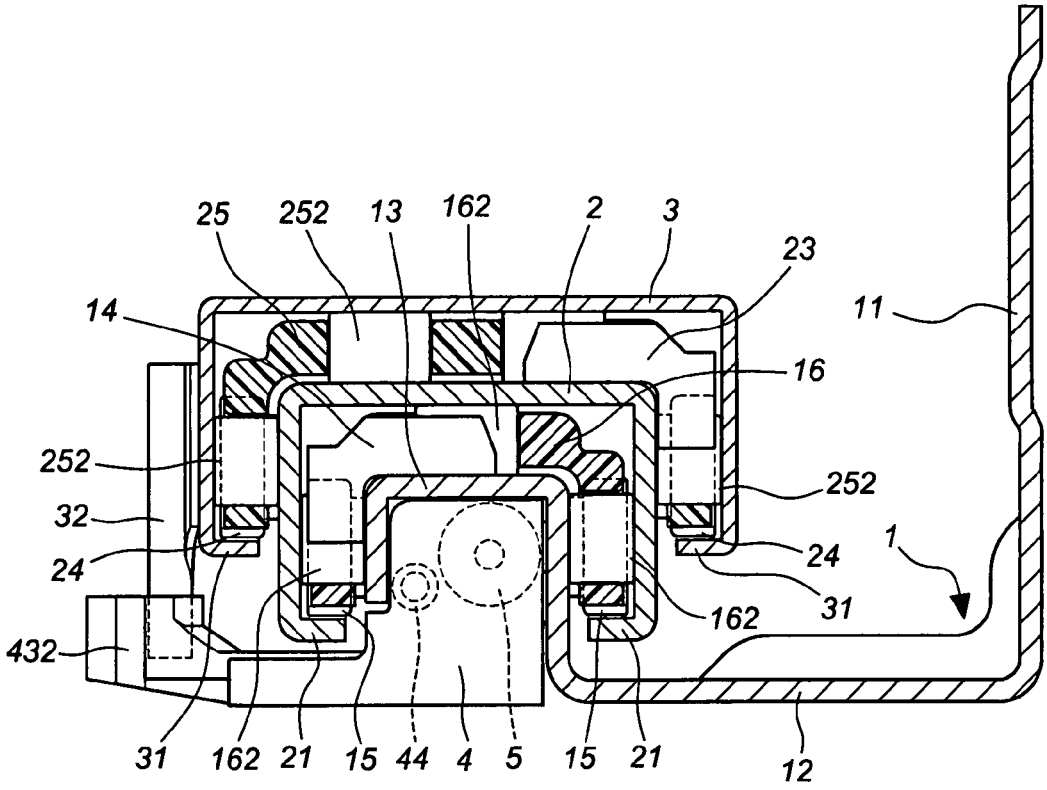
FIG. 9 is a cross-sectional view of the second embodiment of the present invention.
Figure 10:
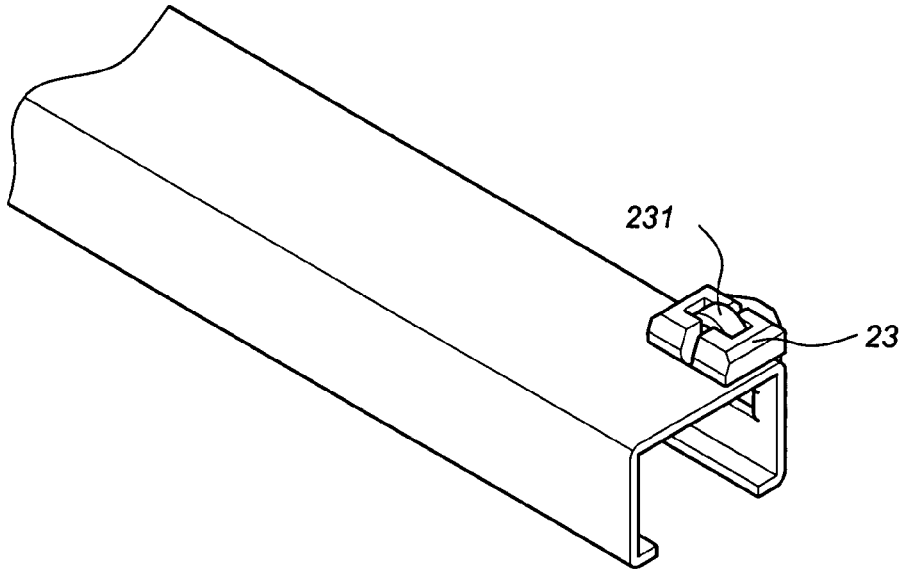
FIG. 10 is a perspective view of a second stopper and a second supporting roller of the second embodiment of the present invention.

Furthermore, the slide member 1 is in conjunction with a two-section slide to form another slide assembly. Other than the slide member 1, the first stopper 14, the first bearing carrier 16, and the first rail 2, as shown in FIGS. 8 and 9, the slide assembly further comprises a second rail 3 fitting onto the first rail 2. The second rail 3 is in a reverse U shape. The second rail 3 has a pair of bending sections 31 extending from two side walls thereof. One of the side walls of the second rail 3 is provided with a second linking part 32. (In this embodiment, the first linking part 22 of the first rail 2 will not be included.) A second stopper 23 is provided on the top of the first rail 2. A pair of second suspension rollers 24 is provided on two side walls of the first rail 2. The bending sections 31 of the second rail 3 engage with the second suspension rollers 24. A second bearing carrier 25 is provided between first rail 2 and the second rail 3. The second bearing carrier 25 comprises a second base 251 in a reverse U shape. Second rollers 252 are provided on the top and two sides of the second base 251. The second bearing carrier 25 will be stopped by the second stopper 23. As shown in FIG. 10, the second stopper 23 may be provided with a second supporting roller 231 with a portion exposed outwardly from the top of the second stopper 23.

As shown in FIG. 9, the track 13 of the slide member 1 is overlapped with the first bearing carrier 16, the first rail 2, the second bearing carrier 25 and the second rail 3 in sequence. The first rail 2 is linked by the first bearing carrier 16 to slide along the track 13, while the second rail 3 is linked by the second bearing carrier 25 to slide along the first rail 2. Meanwhile, the track 13 of the slide member 1 provides a space which is appropriate for installation of the retracting base 4, the elastic element 44, and the buffering member 5.

The first bearing carrier 16 and the second bearing carrier 25 can carry the weight of the first rail 2 and the second rail 3 and link the first rail 2 and the second rail 3 to slide with respect to the track 13 of the slide member 1.

Figure 11:
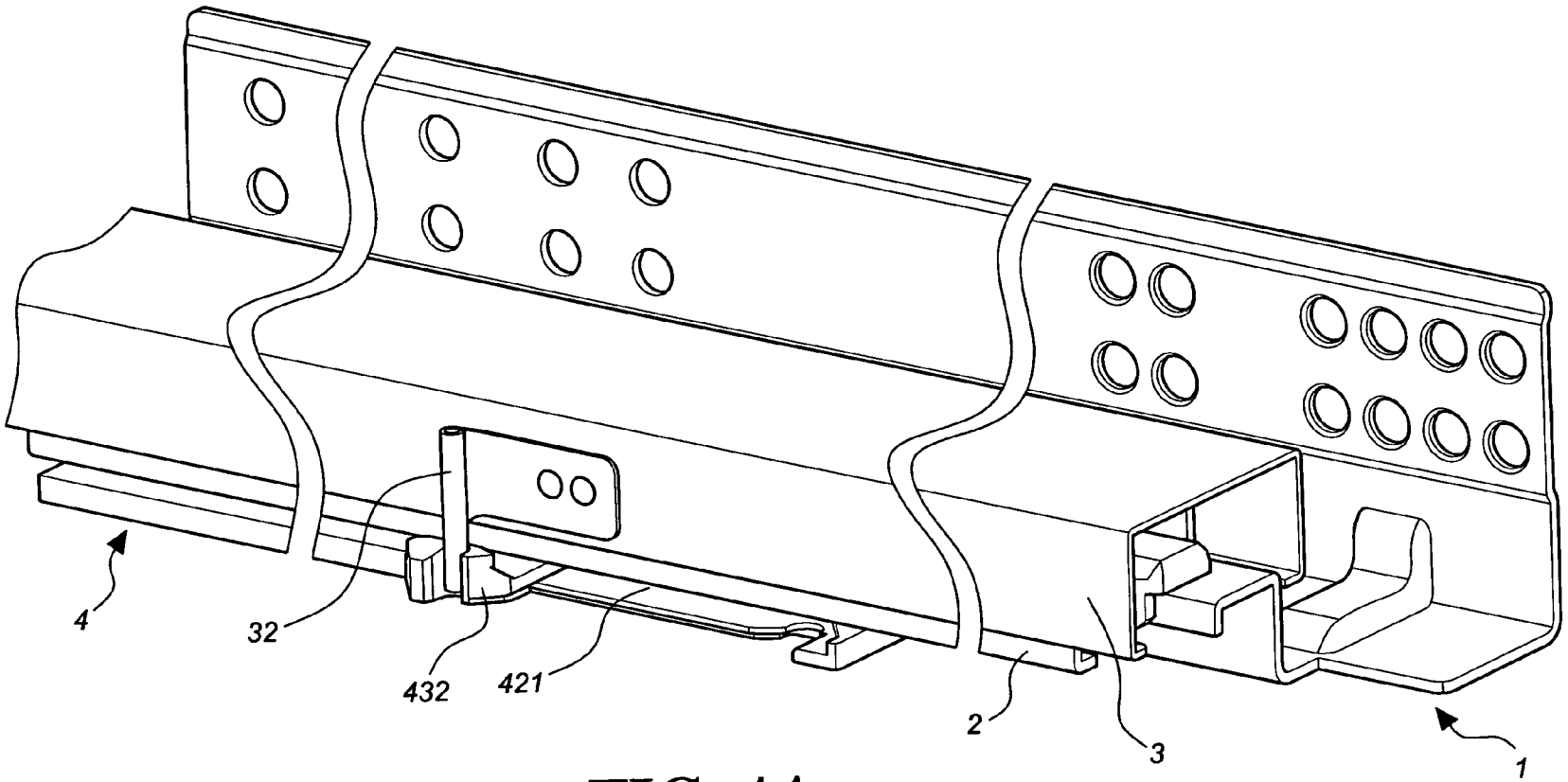
FIG. 11 is a perspective view of the second embodiment of the present invention in a collapsed status.

FIG. 11 shows the operation of the three-section slide assembly of the present invention. When both the first rail 2 and the second rail 3 are retreated onto the slide member 1, the second linking part 32 on the side wall of the second rail 3 will be stopped by the hook 432 of the retracting base 4. That provides a tight collapsing force.

Figure 12:
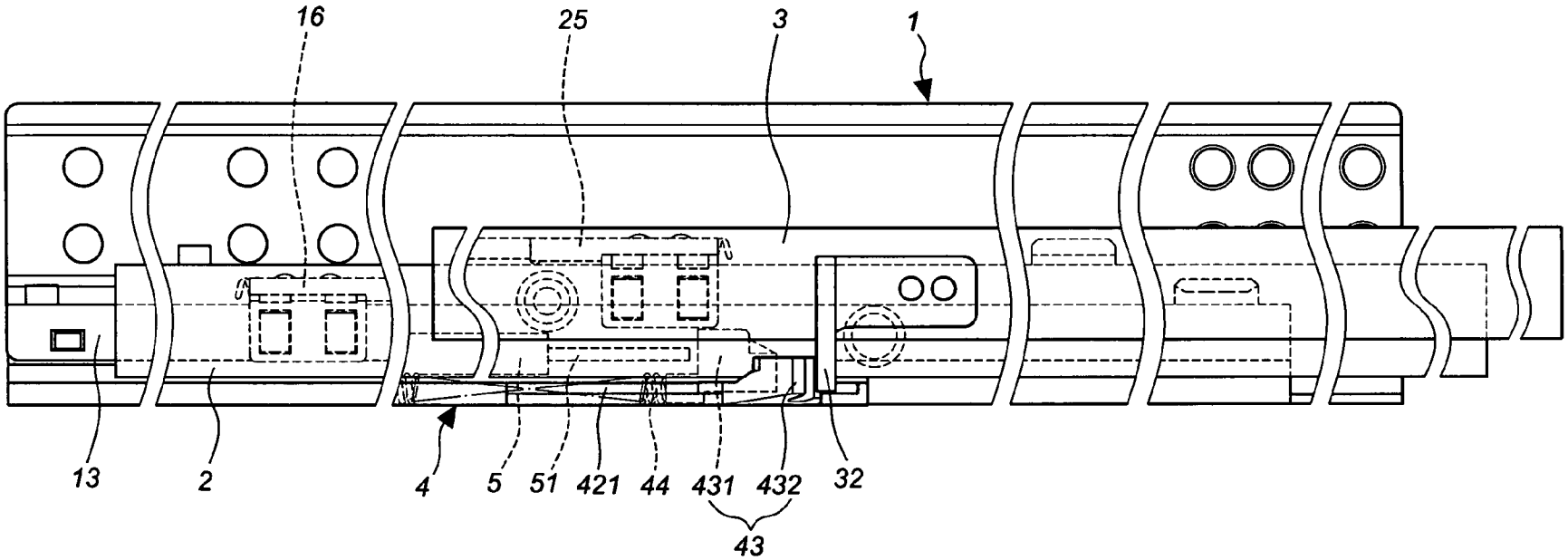
FIG. 12 is a cross-sectional view of the second embodiment of the present invention showing a second rail in an extension status.

As shown in FIG. 12, the second rail 3 is in an extension status. When the second rail 3 is pulled outward, the second linking part 32 on the side wall of the second rail 3 will link the hook 432 to slide along the trough 421 forward until the hook 432 engages with the front of the retracting base 4 and the second linking part 32 disengages with the hook 432. When the second rail 3 is pulled outwardly, the first bearing carrier 16 and the second bearing carrier 25 will slide along the track 13 of the slide member 1 and the first rail 2 outwardly. When the hook 432 of the pulling part 43 is pulled outward by the second linking part 32 of the second rail 3, the block 431 of the pulling part 43 is also linked to move forward, which links the elastic element 44 to be pulled simultaneously. The buffer rod 52 of the buffering member 5 is also linked with the block 431 to extend outwardly, that provides a buffering effect when the second rail 3 and the first rail 2 are pushed inward to slow down the movement.

Figure 13:
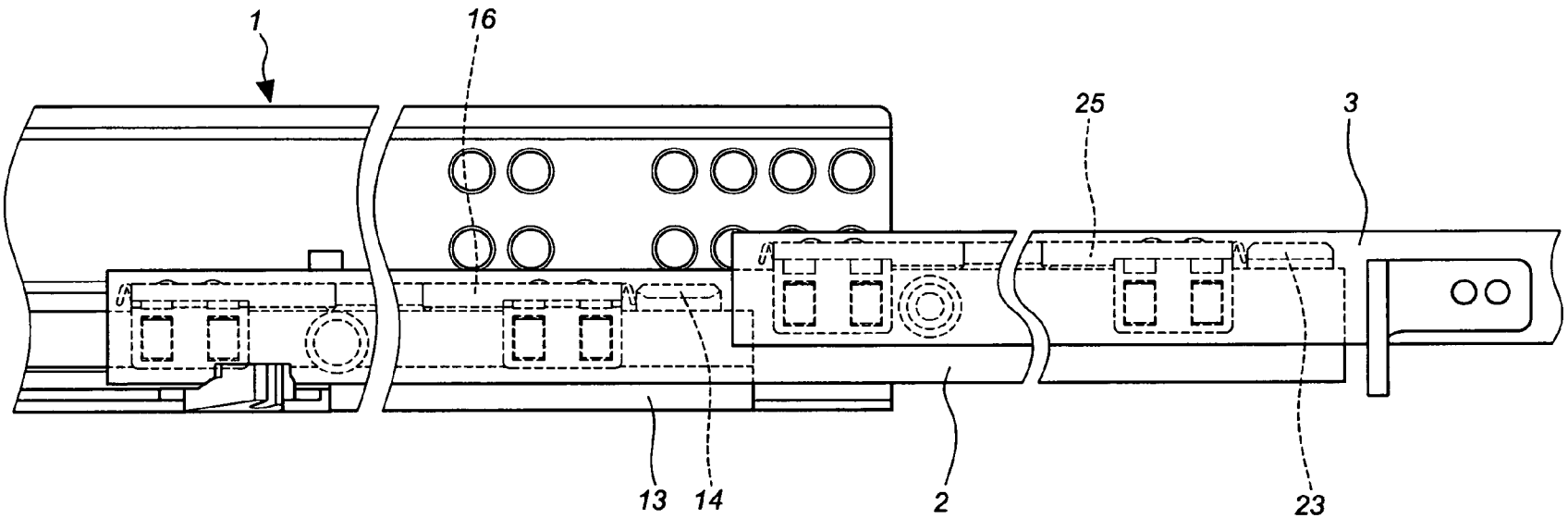
FIG. 13 is a cross-sectional view of the second embodiment of the present invention in a full extension status.

When the first rail 2 and the second rail 3 are in a full extension, as shown in FIG. 13, the front of the first bearing carrier 16 will be in touch with the first stopper 14 at the front of the track 13 of the slide member 1. A stopper (not shown) provided at the rear of the first rail 2 engages with the first bearing carrier 16 to stop the movement. When the second rail 3 is pulled outward in a full extension, the front of the second bearing carrier 25 will be in touch with the second stopper 23 at the front of the first rail 2. A stopper (not shown) provided at the rear of the second rail 3 engages with the second bearing carrier 25 to stop the movement.

What is claimed is:

1. A slide assembly, comprising:

a slide member comprising a side wall, a bottom wall and a track, said side wall extending vertically, said bottom wall extending horizontally to connect with said side wall, said track in a reverse U shape having one side wall extending vertically to connect with said bottom wall, a first stopper being provided on the top of one end of said track, a pair of first suspension rollers being provided on two side walls of said track;

a first rail in a reverse U shape, said first rail having a pair of bending sections extending from two side walls thereof, said first rail fitting onto said track of said slide member with said bending sections engaging with said first suspension rollers, a first bearing carrier being provided between said first rail and said track; and a retracting base provided under said track of said slide member, said retracting base including a vertical engaging section and a horizontal bottom board, said engaging section having a tenon and a through hole, said bottom board having a trough, a pulling part being inserted through said trough, a first linking part being provided on one of said side walls of said first rail, an axle being inserted through said track to secure said first suspension rollers, a locking hole being disposed on one of said side walls of said track, said engaging section of said retracting base being inserted into said track, said tenon engaging with said locking hole and said axle being inserted through said through hole of said engaging section.

2. The slide assembly, as recited in claim 1, wherein said first stopper comprises a first supporting roller with a portion exposing outward from the top of said first stopper.

3. The slide assembly, as recited in claim 1, wherein said first bearing carrier comprises a first base in a reverse U shape, first rollers being provided on the top and two sides of said first base.

4. The slide assembly, as recited in claim 1, wherein an elastic element is provided between said engaging section of said retracting base and said track, said elastic element having two ends connected to said engaging section and said pulling part, respectively, and said first linking part of said first rail being linked with said pulling part.

5. The slide assembly, as recited in claim 1, wherein a buffering member is provided between said track and said engaging section of said retracting base, said buffering member comprising a fixed end and a buffer rod, said fixed end engaging with said engaging section, said buffer rod facing said pulling part.

6. The slide assembly, as recited in claim 4, wherein said pulling part comprises a block and a hook, said block being connected with said elastic member, said hook being pivotally connected to said block and inserted through said trough, said hook engaging with said first linking part of said first rail.

* * * * *